US011079702B2

(12) United States Patent
Saito et al.

(10) Patent No.: US 11,079,702 B2
(45) Date of Patent: Aug. 3, 2021

(54) IMAGE FORMING APPARATUS

(71) Applicant: CANON KABUSHIKI KAISHA, Tokyo (JP)

(72) Inventors: Tomohiro Saito, Kashiwa (JP); Kenta Matsuzaki, Noda (JP); Shozo Aiba, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/703,373

(22) Filed: Dec. 4, 2019

(65) Prior Publication Data

US 2020/0192251 A1 Jun. 18, 2020

(30) Foreign Application Priority Data

Dec. 14, 2018 (JP) ..... JP2018-234943

(51) Int. Cl.
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS 5,778,291 A 7/1998 Okubo et al.
9,280,100 B2 3/2016 Matsuzaki
10,234,797 B2 3/2019 Alba
10,303,077 B2 5/2019 Saito
2007/0172748 A1* 7/2007 Inoue ..... G03G 15/0126 430/45.56
2007/0181251 A1* 8/2007 Ikeda ..... G03G 15/2057 156/294
2008/0310892 A1 12/2008 Inada et al.
2014/0377564 A1* 12/2014 Sakamoto ..... G03G 15/162 428/411.1
2016/0274501 A1* 9/2016 Torimaru ..... G03G 15/0136
2019/0354044 A1 11/2019 Torimaru et al.

FOREIGN PATENT DOCUMENTS

JP 09-152791 A 6/1997
JP 2008-310108 A 12/2008
JP 2010-221647 A 10/2010
JP 2011-232784 A 11/2011

* cited by examiner

*Primary Examiner* — Gregory H Curran
(74) *Attorney, Agent, or Firm* — Venable LLP

(57) ABSTRACT

An image forming apparatus includes a photosensitive member, a rotatable intermediate transfer belt configured to come into contact with a photosensitive member at a first contact portion on an outer peripheral surface thereof, and, a transfer member configured to come into contact with an inner peripheral surface of the intermediate transfer belt at a second contact portion. The transfer member is disposed such that an upstream end of the second contact portion is positioned downstream of a downstream end of the first contact portion in the rotation direction of the intermediate transfer belt. In a case where a surface resistivity measured on the outer peripheral surface of the intermediate transfer belt is G and a surface resistivity measured on the inner peripheral surface of the intermediate transfer belt is N, $0.75 \leq N/G \leq 1.2$ is satisfied.

18 Claims, 10 Drawing Sheets

FIG.5

| Item | Measurement Condition |
|---|---|
| Color Plane | K (%Refl) |
| Orientation | Auto |
| Polarity | Auto |
| Units | μm |
| Minimum Width | 10 |
| Maximum Width | 10000 |
| Subsample | 42 |
| Reverse Order (lead edge at right/bottom) | Uncheck |
| Outer | 30.0 |
| Edge | 60.0 |
| Density | 75.0 |
| Inner | 90.0 |

IMAGE FORMING APPARATUS

BACKGROUND OF THE INVENTION

Field of the Invention

The present invention relates to an image forming apparatus such as a copier, a printer, a facsimile machine, or a multifunctional apparatus having a plurality of functions of these.

Description of the Related Art

For an image forming apparatus, a configuration in which a toner image formed on a photosensitive member, for example, a photosensitive drum, is transferred onto an intermediate transfer belt and then onto a recording material is conventionally known. For example, Japanese Patent Laid-Open No. H09-152791 proposes, as a configuration including an intermediate transfer belt, a configuration in which a primary transfer roller serving as a transfer member disposed on an inner peripheral surface of the intermediate transfer belt is offset downstream in a rotation direction of the intermediate transfer belt with respect to the photosensitive drum.

Here, it has been found that, in the case where the primary transfer roller is offset downstream with respect to the photosensitive drum, the following problem arises unless a relationship between a surface resistivity G measured on the outer peripheral surface of the intermediate transfer belt and a surface resistivity N measured on the inner peripheral surface of the intermediate transfer belt is appropriate.

That is, in the case where the relationship between N and G is not appropriate, there is a risk that scattering of toner to an unintended position on the intermediate transfer belt at a primary transfer portion, an electrical discharge trace in which a part of a toner image on the intermediate transfer belt is missing caused by an electrical discharge between the photosensitive drum and the intermediate transfer belt, or the like occurs.

SUMMARY OF THE INVENTION

The present invention provides a configuration capable of reducing occurrence of scattering and electrical discharge trace even in the case where a transfer member is offset downstream with respect to a photosensitive member.

According to a first aspect of the present invention, an image forming apparatus includes a photosensitive member configured to bear a toner image, a rotatable intermediate transfer belt configured to come into contact with the photosensitive member at a first contact portion on an outer peripheral surface thereof, bear the toner image transferred thereto from the photosensitive member, and transfer the toner image onto a recording material at a transfer portion, and, a transfer member configured to come into contact with an inner peripheral surface of the intermediate transfer belt at a second contact portion, and transfer the toner image on the photosensitive member onto the intermediate transfer belt by being applied a transfer bias. The transfer member is disposed at a position upstream of the transfer portion in a rotation direction of the intermediate transfer belt such that an upstream end of the second contact portion is positioned downstream of a downstream end of the first contact portion in the rotation direction of the intermediate transfer belt. The intermediate transfer belt includes a base layer and a surface layer provided on an outer peripheral surface of the base layer. In a case where a surface resistivity measured on the outer peripheral surface of the intermediate transfer belt is G and a surface resistivity measured on the inner peripheral surface of the intermediate transfer belt is N, $0.75 \leq N/G \leq 1.2$ is satisfied.

According to a second aspect of the present invention, an image forming apparatus includes a photosensitive member configured to bear a toner image, a rotatable intermediate transfer belt configured to come into contact with the photosensitive member at a first contact portion on an outer peripheral surface thereof, bear the toner image transferred thereto from the photosensitive member, and transfer the toner image onto a recording material at a transfer portion, and, a transfer member configured to come into contact with an inner peripheral surface of the intermediate transfer belt at a second contact portion, and transfer the toner image on the photosensitive member onto the intermediate transfer belt by being applied a transfer bias. The transfer member is disposed at a position upstream of the transfer portion in a rotation direction of the intermediate transfer belt such that an upstream end of the second contact portion is positioned downstream of a downstream end of the first contact portion in the rotation direction of the intermediate transfer belt. The intermediate transfer belt is formed to have different resistivities on the outer peripheral surface side and the inner peripheral surface side thereof, and in a case where a surface resistivity measured on the outer peripheral surface of the intermediate transfer belt is G and a surface resistivity measured on the inner peripheral surface of the intermediate transfer belt is N, $0.75 \leq N/G \leq 1.2$ is satisfied.

Further features of the present invention will become apparent from the following description of exemplary embodiments with reference to the attached drawings.

BRIEF DESCRIPTION OF THE DRAWINGS

FIG. 5 is a table showing line measurement conditions of Blur.

DESCRIPTION OF THE EMBODIMENTS

Figure 1:
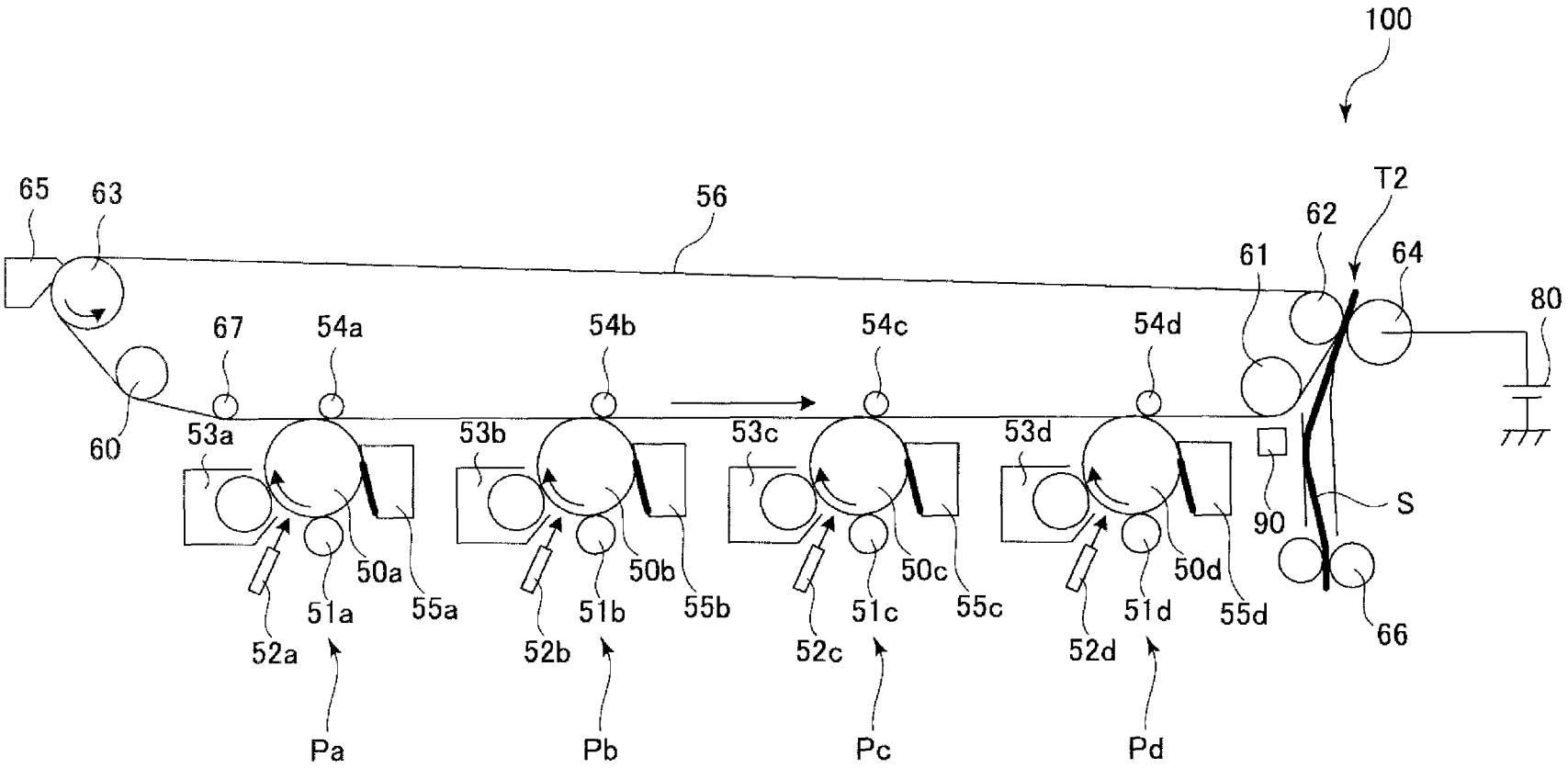
FIG. 1 is a schematic configuration diagram of an image forming apparatus according to an exemplary embodiment.

An exemplary embodiment will be described with reference to FIGS. 1 to 10. First, a schematic configuration of an image forming apparatus of the exemplary embodiment will be described with reference to FIG. 1.

Image Forming Apparatus

An image forming apparatus 100 is a full-color printer of an electrophotographic system including four image forming portions Pa, Pb, Pc, and Pd provided in correspondence with four colors of yellow, magenta, cyan, and black. In the present exemplary embodiment, a tandem configuration in which the image forming portions Pa, Pb, Pc, and Pd are arranged along a rotation direction of an intermediate transfer belt 56 that will be described later is employed. The image forming apparatus 100 forms a toner image on a recording material S in accordance with an image signal from an unillustrated document reading apparatus connected to an apparatus body of the image forming apparatus 100 or a host device such as a personal computer communicably connected to the apparatus body. Examples of the recording material include sheet materials such as paper sheets, plastic films, and cloths.

The outline of such an image formation process will be described. First, in the image forming portions Pa, Pb, Pc, and Pd, toner images of respective colors are formed on photosensitive drums 50*a*, 50*b*, 50*c*, and 50*d*. The toner images of respective colors formed in this manner are transferred onto the intermediate transfer belt 56, and then transferred onto the recording material S from the intermediate transfer belt 56. The recording material S onto which the toner images have been transferred is conveyed to an unillustrated fixing unit, and the toner images are fixed to the recording material S. Details of this will be described below.

To be noted, the four image forming portions Pa, Pb, Pc, and Pd included in the image forming apparatus 100 substantially have the same configuration except that colors used for development are different. Therefore, the image forming portion Pa will be described below as a representative, and constituents of the other image forming portions will be denoted by replacing the affix "a" of constituents of the image forming portion Pa by b, c, and d, respectively, and description thereof will be omitted.

The image forming portion Pa includes a cylindrical photosensitive member serving as an image bearing member, that is, a photosensitive drum 50*a*. The photosensitive drum 50*a* is capable of bearing a toner image, and is rotationally driven in an arrow direction in FIG. 1. A charging roller 51*a* serving as a charging unit, a developing unit 53*a*, a primary transfer roller 54*a* serving as a transfer roller, and a cleaning unit 55*a* are disposed around the photosensitive drum 50*a*. An exposing unit 52*a* that is a laser scanner is disposed below the photosensitive drum 50*a* in FIG. 1.

In addition, the intermediate transfer belt 56 is disposed to oppose the photosensitive drums 50*a*, 50*b*, 50*c*, and 50*d*. The intermediate transfer belt 56 is stretched over a plurality of stretching rollers, and circulates, that is, rotates, in an arrow direction in FIG. 1 by being driven by a driving roller 63. A secondary transfer outer roller 64 serving as a secondary transfer member is disposed at a position opposing a secondary transfer inner roller 62 with the intermediate transfer belt 56 therebetween, and constitutes a secondary transfer portion T2 that transfers the toner images on the intermediate transfer belt 56 onto the recording material S. The fixing unit is disposed downstream of the secondary transfer portion T2 in a conveyance direction of the recording material.

A process of forming an image by the image forming apparatus 100 configured as described above will be described. First, the surface of the rotating photosensitive drum 50*a* is uniformly charged by the charging roller 51*a*. Then, the photosensitive drum 50*a* is exposed by laser light corresponding to an image signal and emitted from the exposing unit 52*a*. As a result of this, an electrostatic latent image corresponding to the image signal is formed on the photosensitive drum 50*a*. The electrostatic latent image on the photosensitive drum 50*a* is developed into a visible image by a developer accommodated in the developing unit 53*a*, which is toner in the present exemplary embodiment. To be noted, although a two-component developer including nonmagnetic toner and magnetic carrier is used as the developer in the present exemplary embodiment, the developer may be a one-component developer including magnetic toner.

Figure 2:
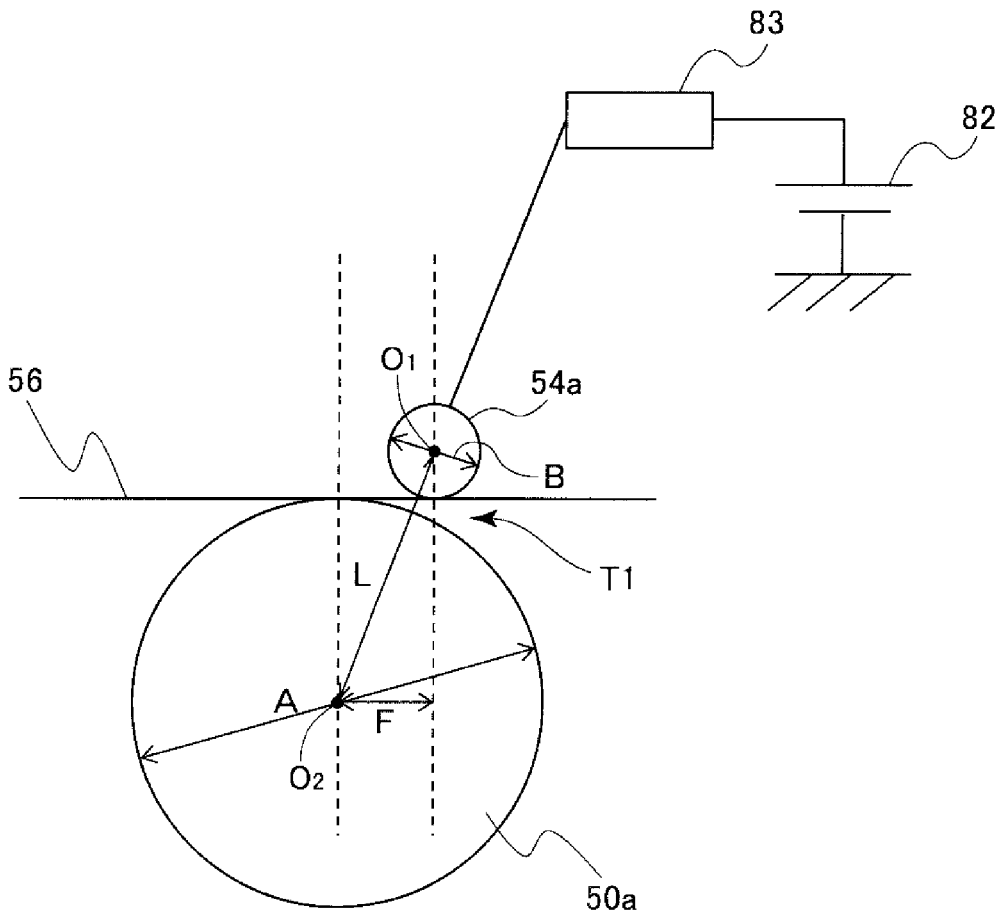
FIG. 2 is a schematic diagram illustrating a configuration a primary transfer portion according to the exemplary embodiment.

The toner image formed on the photosensitive drum 50*a* is transferred onto the intermediate transfer belt 56 through primary transfer in a primary transfer portion T1 illustrated in FIG. 2 formed between the photosensitive drum 50*a* and the primary transfer roller 54*a* serving as a transfer member with the intermediate transfer belt 56 therebetween. Toner remaining on the surface of the photosensitive drum 50*a* after the primary transfer, that is, transfer residual toner is removed by the cleaning unit 55*a*.

This operation is sequentially performed also in the image forming portions of magenta, cyan, and black, and toner images of four colors are superimposed on one another on the intermediate transfer belt 56. Then, the recording material S accommodated in an unillustrated cassette is conveyed to the secondary transfer portion T2 by registration rollers 66 at a timing matching the timing of formation of the toner image, and the toner image of four colors on the intermediate transfer belt 56 is collectively transferred onto the recording material S through secondary transfer. That is, in the present exemplary embodiment, a cassette, an unillustrated pickup roller, the registration rollers 66, and the like are provided. The cassette accommodates the recording material S. The pickup roller picks up and conveys the recording material S accommodated in the cassette at a predetermined timing. The registration rollers 66 convey the recording material S fed by the pickup roller to the secondary transfer portion T2.

Toner not completely transferred in the secondary transfer portion T2 and remaining on the intermediate transfer belt 56 is removed by a belt cleaning unit 65. That is, the belt cleaning unit 65 is disposed downstream of the secondary transfer portion T2 in the rotation direction of the intermediate transfer belt 56. The belt cleaning unit 65 removes residual toner, paper dust, and the like on the intermediate transfer belt 56 after the secondary transfer, and thus cleans the surface of the intermediate transfer belt 56.

Then, the recording material S is conveyed to the fixing unit. The fixing unit heats and pressurizes the recording material S, and thus toners on the recording material S are melted, mixed, and fixed on the recording material S as a full-color image. Then, the recording material S is discharged to the outside of the apparatus. Thus, the series of image formation process is finished. To be noted, an image of a desired single color or multiple colors can be formed by using only one or more desired image forming portions.

Next, the intermediate transfer belt 56 will be described. The intermediate transfer belt 56 is disposed such that the outer peripheral surface thereof is in contact with the photosensitive drums 50*a*, 50*b*, 50*c*, and 50*d*, and rotates in an arrow direction. As described above, toner images are transferred from the photosensitive drums 50*a*, 50*b*, 50*c*, and 50*d* onto the intermediate transfer belt 56 through primary transfer.

The intermediate transfer belt 56 is stretched over a plurality of stretching rollers including the driving roller 63, idler rollers 61 and 67, the secondary transfer inner roller 62, and a tension roller 60. The tension roller 60 is configured to apply a certain tension to the intermediate transfer belt 56. For example, the tension is about 29.4 N to 117.6 N, that is, about 3 kgf to 12 kgf. The intermediate transfer belt 56 is circulated, that is, rotated at a predetermined speed by rotationally driving the driving roller 63 by an unillustrated driving unit.

The idler roller 61 serving as a pre-driving roller is disposed in the vicinity of and upstream of the secondary transfer inner roller 62 in the rotation direction of the intermediate transfer belt 56. A stretched surface of the intermediate transfer belt 56 stretched over the idler rollers 61 and 67 is opposed to the photosensitive drums 50*a*, 50*b*, 50*c*, and 50*d*. The primary transfer rollers 54*a*, 54*b*, 54*c*, and 54*d* are disposed between the idler rollers 61 and 67 so as to be in contact with the inner peripheral surface of the intermediate transfer belt 56.

The primary transfer rollers 54*a*, 54*b*, 54*c*, and 54*d* are subjected to application of a voltage serving as a transfer bias having a polarity opposite to the charging polarity of toner, and thus causes toner images to be sequentially electrostatically attracted to the intermediate transfer belt 56 from the photosensitive drums 50*a*, 50*b*, 50*c*, and 50*d* in primary transfer. As a result of this, the toner images of respective colors are superimposed on one another on the intermediate transfer belt 56. Details of the configuration of the primary transfer portion will be described later.

The secondary transfer inner roller 62 is disposed in contact with the inner peripheral surface of the intermediate transfer belt 56 such that the intermediate transfer belt 56 is nipped between the secondary transfer inner roller 62 and the secondary transfer outer roller 64 serving as a secondary transfer member. The secondary transfer outer roller 64 is disposed on the toner image bearing surface side, that is, the outer peripheral surface side of the intermediate transfer belt 56 in contact with the outer peripheral surface of the intermediate transfer belt 56, and transfers the toner images from the intermediate transfer belt 56 onto the recording material S by receiving application of a voltage. The secondary transfer outer roller 64 is connected to a high-voltage power source 80, and a voltage of a polarity opposite to the charging polarity of the toner serving as a secondary transfer bias is applied to the secondary transfer outer roller 64. In addition, the high-voltage power source 80 is capable of changing the secondary transfer bias.

That is, in an image formation operation, the secondary transfer outer roller 64 rotates in accordance with traveling of the intermediate transfer belt 56. After various control is performed, the recording material S is conveyed to the secondary transfer portion T2. At this time, the secondary transfer bias having a polarity opposite to the charging polarity of the toner is applied to the secondary transfer outer roller 64 to transfer the toner images formed on the intermediate transfer belt 56 onto the recording material S through secondary transfer. In the present exemplary embodiment, the toner has a negative charging polarity, and the secondary transfer bias is a positive bias.

In addition, the secondary transfer inner roller 62 is a rubber roller including an elastic layer such as a layer of ethylene-propylene diene monomer rubber: EPDM on the surface of a core metal. For example, the diameter of the roller is 20 mm and the thickness of the rubber is 0.5 mm. The hardness of the rubber roller is set to, for example, 70° as measured by an ASKER C-type durometer. In contrast, the secondary transfer outer roller 64 includes an elastic layer formed from nitrile butadiene rubber: NBR, EPDM, or the like around a core metal, and is formed to have a diameter of, for example, 20 mm. The resistance of the secondary transfer outer roller 64 is set to $3.0\times10^7\Omega$ to $5.0\times10^7\Omega$, and in the secondary transfer portion T2, the resistances of the secondary transfer inner roller 62 and the intermediate transfer belt 56 are sufficiently smaller than the resistance of the secondary transfer outer roller 64.

Primary Transfer Portion

Next, the configuration of the primary transfer portion T1 will be described with reference to FIG. 2. FIG. 2 illustrates a positional relationship between the photosensitive drum 50*a* and the primary transfer roller 54*a* in the image forming portion Pa of the present exemplary embodiment. To be noted, the same applies to the other image forming portions.

The primary transfer roller 54*a* is connected to a power source 82. The power source 82 is controlled by a bias control unit 83 and thus applies a primary transfer bias to the primary transfer roller 54*a* for transferring the toner image on the photosensitive drum 50*a* onto the intermediate transfer belt 56 through primary transfer. The primary transfer bias is a positive bias similarly to the secondary transfer bias.

A primary transfer current Itg that flows between the primary transfer roller 54*a* and the photosensitive drum 50*a* when the primary transfer bias is applied to the primary transfer roller 54*a* satisfies $5.0\ \mu A \leq Itg \leq 40\ \mu A$, and preferably satisfies $10.0\ \mu A \leq Itg \leq 30\ \mu A$. In the case where Itg is smaller than 5.0 μA, the toner image is not likely to be appropriately transferred in the primary transfer. Therefore, by setting Itg to 5.0 μA or more, preferably 10.0 μA or more, the toner image becomes more likely to be appropriately transferred onto the intermediate transfer belt 56. Meanwhile, in the case where Itg is larger than 40 μA, an electrical discharge trace that will be described later becomes more likely to be generated between the photosensitive drum 50*a* and the intermediate transfer belt 56. Therefore, by setting Itg to 40 μA or less, preferably 30 μA or less, electrical discharge that generates an electrical discharge trace becomes less likely to occur.

The primary transfer roller 54*a* is a metal roller formed from SUM, that is, a sulfur and sulfur-composite free-cutting steel surface-treated by electroless nickel plating, in other words, KN plating, or SUS, that is, stainless steel. The primary transfer roller 54*a* is formed in a straight shape whose diameter is about 6 mm to 10 mm and approximately constant in the axial direction. In the present exemplary embodiment, a metal roller having a diameter of 8 mm is used. To be noted, the primary transfer roller 54*a* may be, for example, a metal roller including an elastic layer on the surface thereof instead of the metal roller described above. In the case of providing an elastic layer on the surface of the metal roller, the elastic layer may be thin.

In the present exemplary embodiment, since a metal roller is used as the primary transfer roller 54*a*, a configuration that is less affected by environmental change such as temperature change can be obtained at a lower cost than in the case of using, for example, a foam roller formed by providing a thick elastic layer on the outer peripheral surface of a core metal as the primary transfer roller. In the case of using a metal roller as the primary transfer roller 54*a*, the following configuration is employed to secure a transfer nip portion of a sufficient length between the primary transfer roller 54*a* and the intermediate transfer belt 56 in the primary transfer portion.

Figure 6:
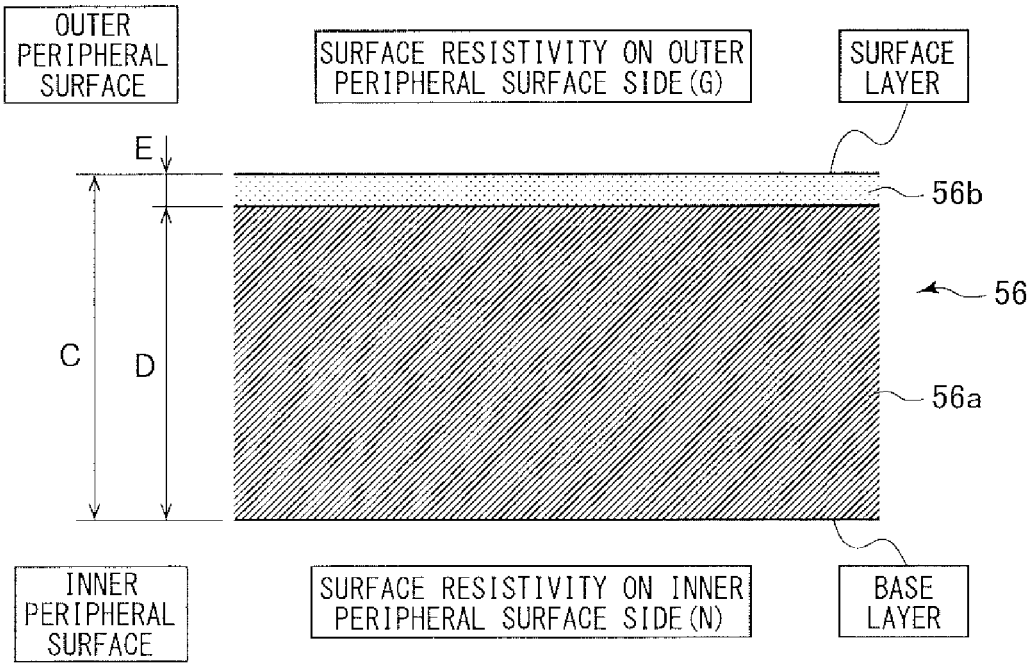
FIG. 6 is a schematic diagram illustrating a layer configuration of an intermediate transfer belt according to the exemplary embodiment.

That is, the primary transfer roller 54*a* is disposed such that a rotation center $O_1$ of the primary transfer roller 54*a* is positioned downstream of a rotation center $O_2$ of the photosensitive drum 50*a* in the rotation direction of the intermediate transfer belt 56. Further, the primary transfer roller 54*a* is disposed such that a distance L between the rotation center $O_2$ of the photosensitive drum 50*a* and the rotation center $O_1$ of the primary transfer roller 54*a* satisfies $L>(A/2)+(B/2)+C$. Here, A represents the diameter of the photosensitive drum 50*a*, B represents the diameter of the primary transfer roller 54*a*, and C represents the thickness of the intermediate transfer belt 56. This is illustrated in FIG. 6 that will be described later. That is, the primary transfer roller 54*a* is offset downstream with respect to the photosensitive drum 50*a*.

In addition, a region where the photosensitive drum 50*a* comes into contact with the outer peripheral surface of the intermediate transfer belt 56 will be referred to as a first contact portion, and a region where the primary transfer roller 54*a* comes into contact with the inner peripheral surface of the intermediate transfer belt 56 will be referred to as a second contact portion. In this case, the primary transfer roller 54*a* is disposed at a position upstream of the secondary transfer portion T2 in the rotation direction of the intermediate transfer belt 56 such that an upstream end of the second contact portion is positioned downstream of a downstream end of the first contact portion. Specifically, the primary transfer roller 54*a* is disposed at such a position that the region where the primary transfer roller 54*a* comes into contact with the intermediate transfer belt 56 does not overlap with the region where the photosensitive drum 50*a* comes into contact with the intermediate transfer belt 56 as viewed in the thickness direction of the intermediate transfer belt 56.

In addition, an offset amount F of the rotation center $O_1$ of the primary transfer roller 54*a* with respect to the rotation center $O_2$ of the photosensitive drum 50*a* in the rotation direction of the intermediate transfer belt 56 satisfies $4.0\ mm \leq F \leq 7.0\ mm$. That is, the offset amount F is a distance between a perpendicular line drawn from the center axis of the photosensitive drum 50*a* to the intermediate transfer belt 56 and a perpendicular line drawn from the center axis of the primary transfer roller 54*a* to the intermediate transfer belt 56. Further, the primary transfer roller 54*a* is disposed such that the offset amount F is 4.0 mm to 7.0 mm. The offset amount F may be 5 mm or more and 6 mm or less. In the present exemplary embodiment, the offset amount F is set to 7.0 mm.

In addition, a load of the primary transfer roller 54*a* in a direction which is perpendicular to a direction of movement of the intermediate transfer belt 56 in the primary transfer portion and in which the intermediate transfer belt 56 is pushed toward the photosensitive drum 50*a* is 100 gf to 400 gf and preferably 200 gf to 300 gf. In addition, the primary transfer roller 54*a* is disposed such that the primary transfer roller 54*a* sinks in the intermediate transfer belt 56 by 0.1 mm to 0.3 mm. To be noted, as a method of bringing the primary transfer roller 54*a* into pressure contact with the intermediate transfer belt 56, the pressure contact may be managed on the basis of a total pressure in a direction toward the photosensitive drum 50*a* applied to the primary transfer roller 54*a* urged by a spring. The spring urges a bearing supporting the primary transfer roller 54*a*.

Figure 3:
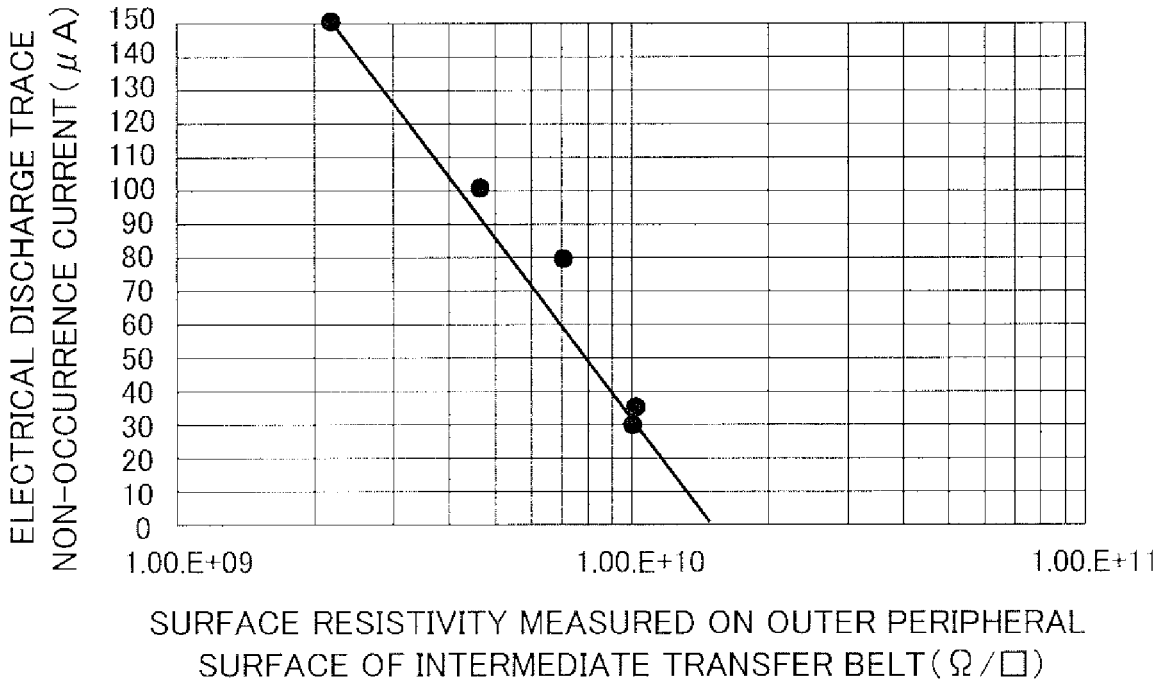
FIG. 3 is a graph showing a relationship between a surface resistivity measured on the outer peripheral surface of the intermediate transfer belt and an electrical discharge trace non-occurrence current.

Here, in the case of using a metal roller as the primary transfer roller 54*a*, an abnormal image in which a toner image is defected by an electrical discharge between the photosensitive drum 50*a* and the intermediate transfer belt 56 might occur. This abnormal image will be referred to as an electrical discharge trace. As illustrated in FIG. 3, it is known that the upper limit of a primary transfer current with which an electrical discharge trace occurs changes depending on the surface resistivity measured on the outer peripheral surface of the intermediate transfer belt 56. This upper limit will be referred to as an electrical discharge trace non-occurrence current. The primary transfer current is a transfer current that flows from the primary transfer roller 54*a* to the photosensitive drum 50*a* when a primary transfer bias is applied to the primary transfer roller 54*a*.

The surface resistivity of the intermediate transfer belt 56 was measured by using a measurement device of Hiresta UP manufactured by Mitsubishi Chemical Corporation and a measurement probe of URS manufactured by Mitsubishi Chemical having a guard electrode outer diameter of φ17.9 mm in a measurement condition of an applied voltage of 1000 V and a charge of 10 seconds. The atmospheric temperature of the measurement environment was 23° C. and the humidity thereof was 50%.

Figure 4:
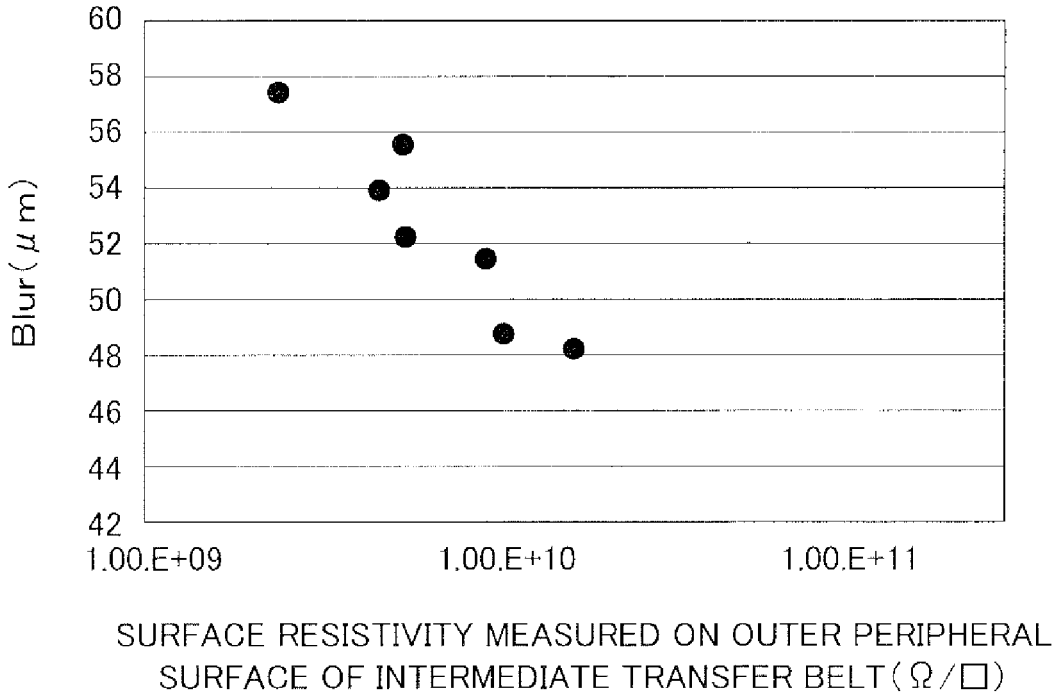
FIG. 4 is a graph showing a relationship between the surface resistivity measured on the outer peripheral surface of the intermediate transfer belt and Blur.

In addition, for an image forming apparatus such as a printer that forms a color image by an electrophotographic system, a configuration that reduces toner scattering and transfers dots and fine lines with high precision is desired. A relationship between toner scattering and the surface resistivity measured on the outer peripheral surface of the intermediate transfer belt will be described with reference to FIG. 4. Blur shown in FIG. 4 is a numerical value indicating bluffing of fine lines, that is, toner scattering. Measurement was performed on a 4-dot line image of a single color of black toner in the sub-scanning direction formed on a paper sheet CS-068 manufactured by Canon Inc. by using PIAS-II manufactured by QEA. The line measurement conditions are shown in FIG. 5. It is known that the toner scattering changes depending on the surface resistivity measured on the outer peripheral surface of the intermediate transfer belt, and as illustrated in FIG. 4, the toner scattering can be reduced by increasing the surface resistivity. The measurement of the surface resistivity of the intermediate transfer belt 56 is the same as in the case illustrated in FIG. 3.

As described above, electrical discharge traces and toner scattering may sometimes become more likely to occur on the intermediate transfer belt 56 depending on the surface resistivity measured on the outer peripheral surface of the intermediate transfer belt 56. Therefore, the intermediate transfer belt 56 is configured as shown below in the present exemplary embodiment.

Intermediate Transfer Belt

The configuration of the intermediate transfer belt 56 will be described with reference to FIG. 6. The intermediate transfer belt 56 includes a base layer 56*a* and a surface layer 56*b* provided on the outer peripheral surface of the base layer 56*a*. The surface layer 56*b* is a coating layer formed directly on the base layer 56*a* for securing toner releasability. That is, the intermediate transfer belt 56 has a bilayer structure. However, the surface layer 56*b* may include the coating layer and an adhesive layer that bonds the coating layer and the base layer 56*a* to each other. That is, the intermediate transfer belt 56 may have a three-layer structure.

Base Layer

First, the base layer 56*a* will be described. The base layer 56*a* contains one of polyimide: PI, polyamide: PA, polyphenylene sulfide: PPS, polyetherimide: PEI, and polyether ether ketone: PEEK. In addition, the base layer 56*a* is formed by dispersing conductive filler such as carbon, an ionic conductive material, or the like of an appropriate amount in one of these resins.

In addition, a surface resistivity $\alpha$ of the base layer 56*a* itself satisfies $1.0\times10^{9}\ \Omega/\square\leq\alpha\leq1.0\times10^{13}\Omega/\square$, and preferably satisfies $6.3\times10^{9}\ \Omega/\square\leq\alpha\leq3.2\times10^{10}\Omega/\square$. A thickness D of the base layer 56*a* satisfies 30 μm≤D≤100 μm.

Surface Layer

Next, the surface layer 56*b* will be described. The surface layer 56*b* at least contains a binder resin and perfluoropolyether: PFPE. That is, the surface layer 56*b* is mainly constituted by the binder resin, the perfluoropolyether: PFPE, a dispersing agent, other additives, and the like. Each component will be described in detail below.

Binder Resin

The binder resin contained in the surface layer 56*b* is used for dispersing PFPE, securing adhesion to the base layer 56*a*, securing mechanical strength, and the like. Examples of the binder resin in the present exemplary embodiment include styrene resin, acrylic resin, methacrylic resin, epoxy resin, polyester resin, polyether resin, silicone resin, and polyvinyl butyral resin. A mixture of these may be also used. Among these binder resins, methacrylic resin or acrylic resin is particularly preferably used. Methacrylic resin and acrylic resin will be collectively referred as acryl-based resin.

The content of the binder resin is preferably 20.0% by mass to 95.0% by mass and more preferably 30.0% by mass to 90.0% by mass with respect to the total mass of the solid component of the surface layer 56*b*.

In addition, the binder resin is preferably solid, and the glass transition temperature of the binder resin is higher than a use temperature range, practically preferably 40° C. or higher and more preferably 50° C. or higher.

Perfluoropolyether: PFPE

Perfluoropolyether is an oligomer or a polymer including perfluoroalkylene ether as a repeating unit. Examples of the repeating unit of perfluoroalkylene ether include repeating units of perfluoromethylene ether, perfluoroethylene ether, and perfluoropropylene ether. Specifically, examples of the perfluoropolyether include DEMNUM manufactured by Daikin Industries, Ltd., Krytox manufactured by DuPont, and Fomblin manufactured by Solvay Solexis.

Dispersing Agent

The surface layer 56*b* preferably contains a dispersing agent for dispersing perfluoropolyether. By containing such a dispersing agent, the dispersed state of the PFPE in the surface layer 56*b* can be stabilized more. As the dispersing agent, surfactants, amphipathic block copolymers, and amphipathic graft copolymers that are compounds including a part having an affinity for a perfluoroalkyl chain and hydrocarbon, that is, compounds including a part having a high affinity for fluorine and a part having a low affinity for fluorine are preferably used. Among these, the following are particularly preferable:

(i) a block copolymer obtained by copolymerizing a vinyl monomer having a fluoroalkyl group and an acrylate or a methacrylate; or (ii) a comb-shaped graft copolymer obtained by copolymerizing an acrylate or methacrylate having a fluoroalkyl group and a methacrylate macro monomer having a polymethyl methacrylate as a side chain.

Examples of the block copolymer of (i) described above include MODIPER F200, F210, F2020, F600, and FT-600 manufactured by NOF Corporation. In addition, examples of the comb-shaped graft copolymer of (ii) described above include fluorine-based graft polymers such as Aron GF-150, GF-300, and GF-400 manufactured by Toagosei. To contain a large amount of PFPE in a binder resin having not many CF3 parts, CF2 parts, and CF parts, it is preferable to use a dispersing agent.

Others

The surface layer 56*b* contains a conductive filler added thereto to impart conductivity thereto. As the conductive filler, known electron-conducting materials and ionic conductive materials can be used. Examples of the electron-conducting materials include carbon black, carbon nanotube, antimony-doped tin oxide, antimony-doped zinc oxide, phosphorus-doped zinc oxide, aluminum-doped zinc oxide, gallium-doped zinc oxide, polyaniline, polythiophene, and polypyrrole. In addition, examples of ionic conductive materials include potassium sulfonate and lithium disulfonate.

Specifically, the surface layer 56*b* having such a configuration coats the base layer 56*a*. First, a polymerizable monomer for forming an acryl-based resin, a solvent, a perfluoropolyether, and a dispersing agent are uniformly dispersed by a wet dispersing apparatus, and thus a dispersion liquid is obtained. This dispersion liquid is applied on the base layer 56*a* by an application method such as bar coating or spray coating. Then, solvent is dried off from the applied dispersion liquid, then the polymerizable monomer is polymerized by heat, an electron beam, or ultraviolet light, and thus the surface layer 56*b* is formed.

At this time, a polymerization initiator may be appropriately used for polymerization. Examples of the polymerization initiator include radical polymerization initiators such as alkylphenone and acylphosphine oxide, cationic polymerization initiators such as aromatic sulfonium salts, and nifedipine anion polymerization initiators. Specifically, examples of the radical polymerization initiators include Irgacure series manufactured by BASF, and examples of the cationic polymerization initiators include SP series manufactured by ADEKA.

In addition, known additives such as the conducting agents described above, oxidation inhibitors, leveling agents, crosslinking agents, and flame retardants may be appropriately mixed therein. In addition, solid filler may be appropriately mixed therein in accordance with required properties, for example, for reinforcement.

A thickness E of the surface layer 56*b* serving as a film thickness can be adjusted to a desired value by adjusting the film formation conditions such as the solid concentration and film formation speed. The thickness E of the surface layer 56*b* satisfies 1 nm≤E≤20.0 μm and preferably 4.0 μm≤E≤6.0 μm. That is, although the value depends on the material of the surface layer, the thickness E is preferably 1 nm or more and more preferably 4 μm or more, in consideration of wear and damage. In addition, in consideration of the flex resistance when the belt is stretched, the thickness E is preferably 20 μm or less, more preferably 10 μm or less, and further preferably 6.0 μm or less.

A surface resistivity $\beta$ of the surface layer 56*b* itself satisfies $4.0\times10^{9}\ \Omega/\square\leq\beta\leq5.0\times10^{10}\Omega/\square$, and preferably satisfies $4.5\times10^{9}\ \Omega/\square\leq\beta\leq4.0\times10^{10}\Omega/\square$.

Further, the surface layer 56*b* is configured such that a contact angle $\theta$ of n-hexadecane is set to $10°\leq\theta\leq90°$ to secure toner releasability of the intermediate transfer belt 56.

The lower limit of the contact angle θ is preferably 20° or more. In addition, the upper limit of the contact angle θ is preferably 70° or less. The contact angle of n-hexadecane on the surface layer 56*b* was measured by a contact angle meter "PORTABLE CONTACT ANGLE METER PCA-1" manufactured by Kyowa Interface Science Co., Ltd. by using n-hexadecane as a probe liquid. To be noted, the amount of dripped n-hexadecane was set to 1 and the measurement time was set to 10 seconds.

Measurement Method for Surface Resistivities α and β

Here, a measurement method for the surface resistivities α and β of the base layer 56*a* itself and the surface layer 56*b* itself, respectively, will be described. First, a surface resistivity G is measured on the outer peripheral surface of the intermediate transfer belt 56 having a bilayer structure. Next, the surface on the outer peripheral surface side, that is, the surface layer 56*b* among the two layers is removed, and a surface resistivity of the remaining layer on the inner peripheral surface side, that is, the base layer 56*a* is measured on the surface that has been in contact with the layer on the outer peripheral surface side, that is, the surface layer 56*b*. The surface resistivity measured herein is used as the surface resistivity α of the base layer 56*a* itself. In addition, the surface resistivity β of the surface layer 56*b* itself is calculated by the following formula:

$$\beta = G \times \alpha / (\alpha - G).$$

*N/G*

Next, N/G of the intermediate transfer belt 56 of the present exemplary embodiment will be described. G represents the surface resistivity measured on the outer peripheral surface of the intermediate transfer belt 56, and N represents the surface resistivity measured on the inner peripheral surface of the intermediate transfer belt 56. In this case, $0.75 \leq N/G \leq 1.2$ is satisfied, and preferably $0.8 \leq N/G \leq 1.0$ is satisfied. In the present exemplary embodiment, it is assumed that N/G monotonically increases with respect to the surface resistivity α of the base layer 56*a*. That is, in the case where the surface resistivity β of the surface layer 56*b* is constant, N/G becomes larger as the surface resistivity α of the base layer 56*a* becomes larger.

In addition, N satisfies $1.0 \times 10^9 \Omega/\square \leq N \leq 1.0 \times 10^{13} \Omega/\square$ from the viewpoint of transferability. Further, N preferably satisfies $1.4 \times 10^9 \Omega/\square \leq N \leq 1.8 \times 10^{10} \Omega/\square$, and more preferably satisfies $1.6 \times 10^9 \Omega/\square \leq N \leq 1.5 \times 10^{10} \Omega/\square$. Meanwhile, G satisfies $1.0 \times 10^9 \Omega/\square \leq G \leq 1.0 \times 10^{13} \Omega/\square$ from the viewpoint of transferability. Further, G preferably satisfies $1.9 \times 10^9 \Omega/\square \leq G \leq 1.5 \times 10^{10} \Omega/\square$, and more preferably satisfies $2.1 \times 10^9 \Omega/\square \leq G \leq 1.4 \times 10^{10} \Omega/\square$.

The surface resistivities α, β, N, and G of the intermediate transfer belt 56 described above are measured in the same manner as described with reference to FIG. 3. The measurement was performed by using a measurement device of Hiresta UP manufactured by Mitsubishi Chemical Corporation and a measurement probe of URS manufactured by Mitsubishi Chemical having a guard electrode outer diameter of φ17.9 mm in a measurement condition of an applied voltage of 1000 V and a charge of 10 seconds. The atmospheric temperature of the measurement environment was 23° C. and the humidity thereof was 50%.

In the present exemplary embodiment, the resistance of the intermediate transfer belt 56 is adjusted such that the requirements of N and G described above are satisfied. For example, a polyimide resin film of a thickness of 60 μm is used as a base material, and the base layer 56*a* whose surface resistivity α is adjusted to $9.8 \times 10^9 \Omega/\square$ or more and $3.0 \times 10^{10} \Omega/\square$ or less is formed by dispersing carbon black in this base material. Further, the surface layer 56*b* having a thickness of 5 μm whose surface resistivity β is adjusted to $7.9 \times 10^9 \Omega/\square$ or more and $1.0 \times 10^{10} \Omega/\square$ or less is formed on the outer peripheral surface side of the base layer 56*a*. In addition, for example, the surface resistivity G measured on the outer peripheral surface of the intermediate transfer belt 56 is set to $5.0 \times 10^9 \Omega/\square$ and the surface resistivity N measured on the inner peripheral surface of the intermediate transfer belt 56 is set to $4.0 \times 10^9 \Omega/\square$. In this case, N/G is 0.8. In addition, the inner periphery length of the intermediate transfer belt 56 is, for example, 893.1 mm, and the intermediate transfer belt 56 rotates at a speed of, for example, 320 mm/s.

Toner Scattering

Next, toner scattering that occurs in the primary transfer portion will be described. To be noted, although the primary transfer portion of the image forming portion Pa will be described as an example, the same applies to the primary transfer portions of the other image forming portions.

Figure 7:
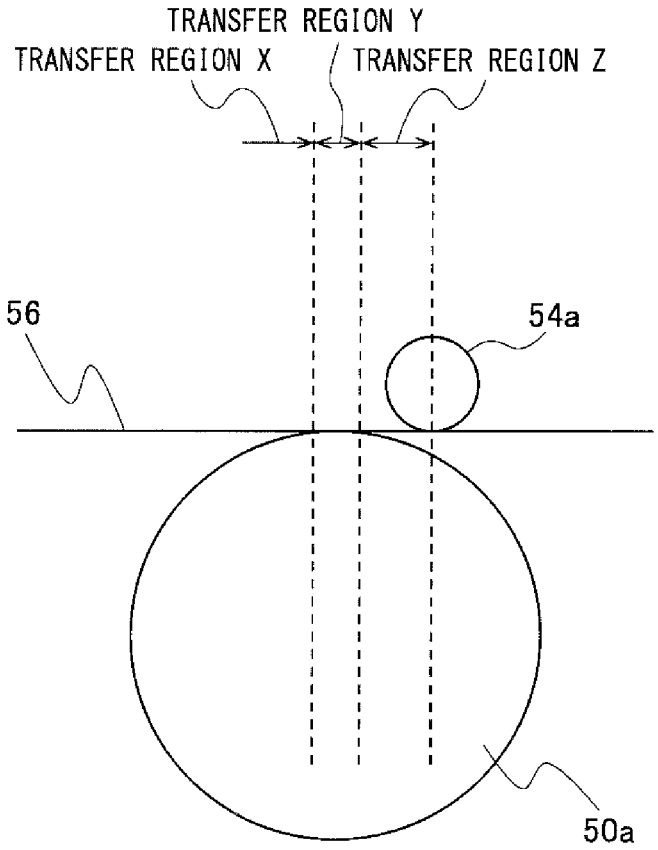
FIG. 7 is a schematic diagram illustrating transfer regions X to Z in a primary transfer portion.

As illustrated in FIG. 7, toner is transferred from the photosensitive drum 50*a* onto the intermediate transfer belt 56 through primary transfer in transfer regions X to Z of the primary transfer portion. The transfer region X is a region which is positioned upstream of a region where the photosensitive drum 50*a* is in contact with the intermediate transfer belt 56, that is, the transfer region Y, in the rotation direction of the intermediate transfer belt 56, and in which the photosensitive drum 50*a* and the intermediate transfer belt 56 are not in contact with each other. The transfer region Y is a region where the photosensitive drum 50*a* and the intermediate transfer belt 56 are in contact with each other. The transfer region Z is a region which is positioned downstream of the transfer region Y in the rotation direction of the intermediate transfer belt 56 and extends to a position where the primary transfer roller 54*a* and the intermediate transfer belt 56 are in contact with each other and in which the photosensitive drum 50*a* and the intermediate transfer belt 56 are not in contact with each other.

Examples of the toner scattering include scattering that occurs in the transfer region X and scattering that occurs in the transfer region Z. The scattering that occurs in the transfer region X will be referred to as upstream scattering, and the scattering that occurs in the transfer region Z will be referred to as downstream scattering. The upstream scattering occurs in the case where the electric field intensity between the photosensitive drum 50*a* and the intermediate transfer belt 56 in the transfer region X is such a value that toner can be transferred from the photosensitive drum 50*a* to the intermediate transfer belt 56 by Coulomb's force. Therefore, to reduce upstream scattering, it is desired that the electric field intensity between the photosensitive drum 50*a* and the intermediate transfer belt 56 in the transfer region X is such a value that toner cannot be transferred.

In addition, the downstream scattering occurs in the case where the amount of toner transferred through primary transfer in the transfer region Y is not sufficient, and toner remaining on the photosensitive drum 50*a* without being transferred through primary transfer in the transfer region Y is conveyed to the transfer region Z and is transferred from the photosensitive drum 50*a* onto the intermediate transfer belt 56 in the transfer region Z. Therefore, to reduce downstream scattering, it is desired that toner of a sufficient amount is transferred through primary transfer in the transfer region Y and thus the amount of toner on the photosensitive drum 50*a* in the transfer region Z is reduced. To achieve this, it is desired that the electric field intensity between the photosensitive drum 50*a* and the intermediate transfer belt 56 in the transfer region Y is set to a sufficiently large value such that toner of a sufficient amount is transferred through primary transfer in the transfer region Y.

As described above, to reduce toner scattering, it is important to reduce upstream scattering and downstream scattering, and to achieve this, it is desired that the electric field intensities in the transfer regions X and Y are set to appropriate values. The electric field intensity in the transfer region X can be controlled in accordance with the surface resistivity G measured on the outer peripheral surface of the intermediate transfer belt 56. Meanwhile, the electric field intensity in the transfer region Y is controlled by setting the ratio N/G of the surface resistivity N measured on the inner peripheral surface of the intermediate transfer belt 56 and the surface resistivity G measured on the outer peripheral surface of the intermediate transfer belt 56 to an appropriate value. In the present exemplary embodiment, N/G is set to be in the range of 0.75 to 1.2.

Figure 8:
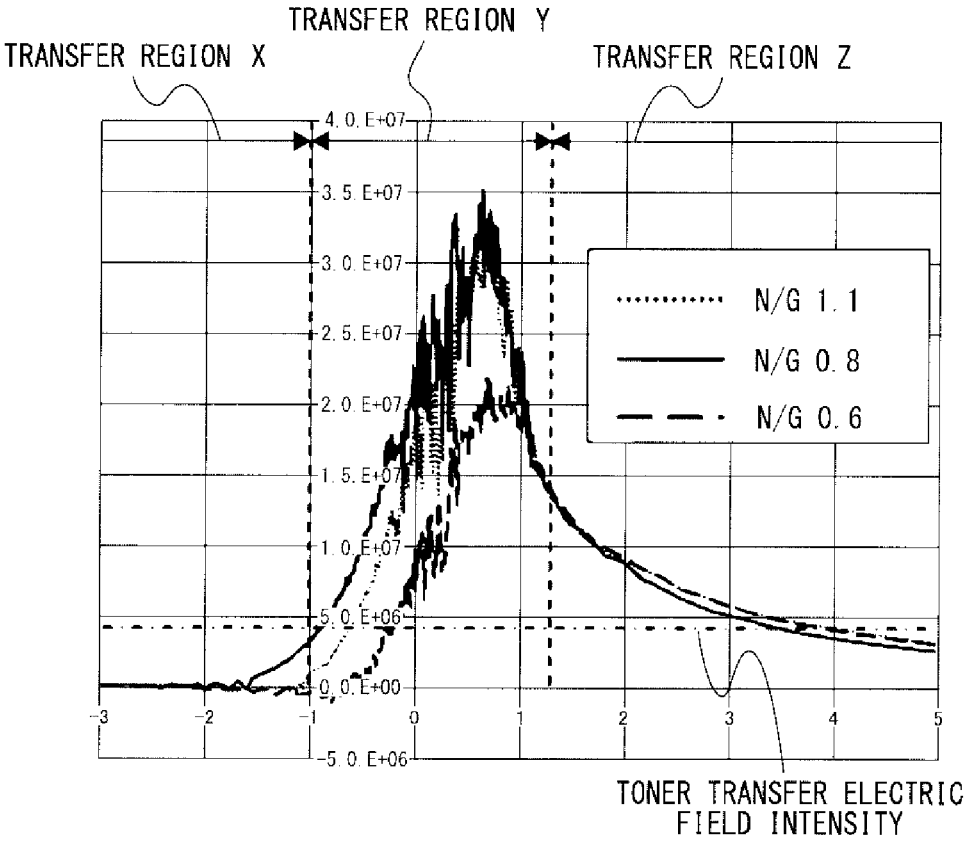
FIG. 8 is a graph showing a relationship between N/G and electric field intensity distribution in the primary transfer portion.

FIG. 8 illustrates electric field intensity distributions in cases where N/G is 0.6, where N/G is 0.8, and where N/G is 1.1. The electric field intensity in the transfer region Y is larger in the cases where N/G is 0.8 and where N/G is 1.1 than in the case where N/G is 0.6. To be noted, to transfer toner through primary transfer in the case where the toner is charged to −30 μC/mg, an electric field intensity higher than a toner transfer electric field intensity illustrated in FIG. 8 is required. In addition, the integral value of the electric field intensity in the transfer region Y is $4.5\times10^9$ V/m in the case where N/G is 0.6, $9.0\times10^9$ V/m in the case where N/G is 0.8, and $8.5\times10^9$ V/m in the case where N/G is 1.1.

Mechanism of Change in Electric Field Intensity Distribution

Figure 9A:
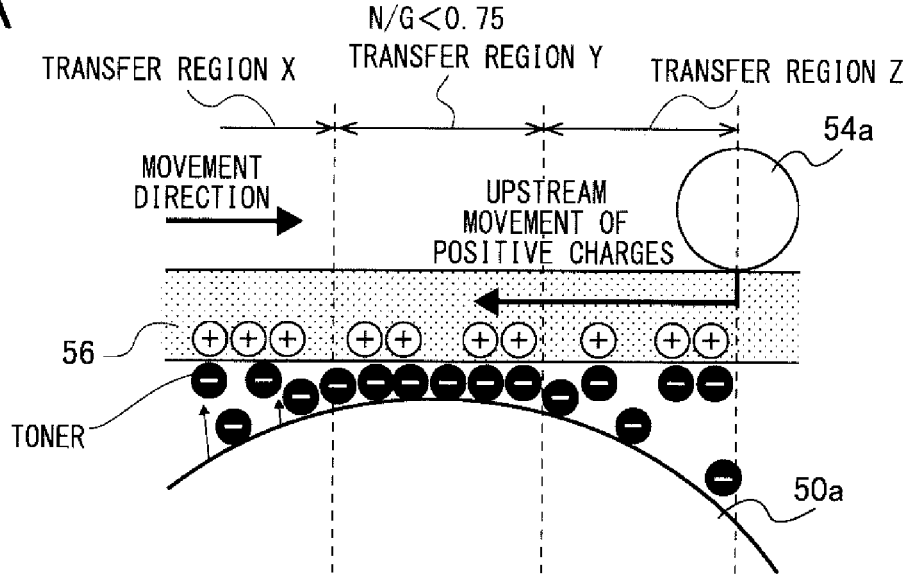
FIG. 9A is a schematic diagram for describing electrical charge transfer in the primary transfer portion in the case where $N/G \leq 0.75$ holds.
Figure 9B:
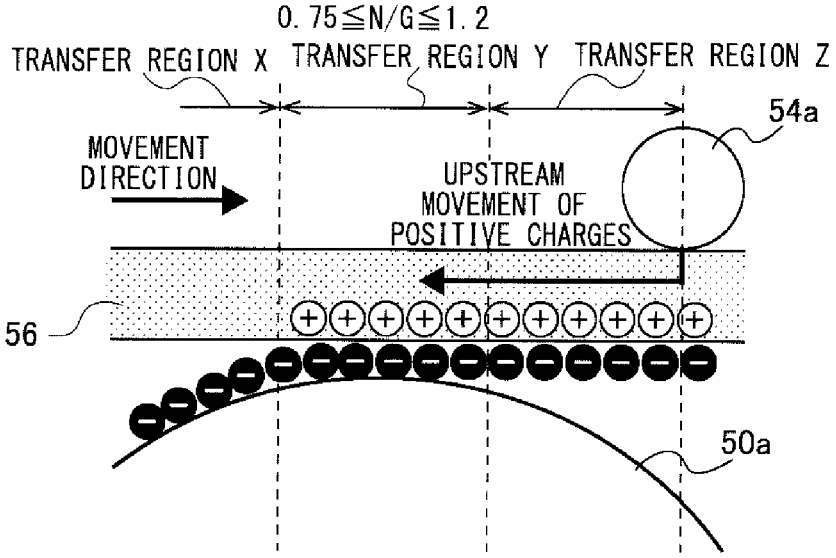
FIG. 9B is a schematic diagram for describing electrical charge transfer in the primary transfer portion in the case where $0.75 \leq N/G \leq 1.2$ holds.
Figure 9C:
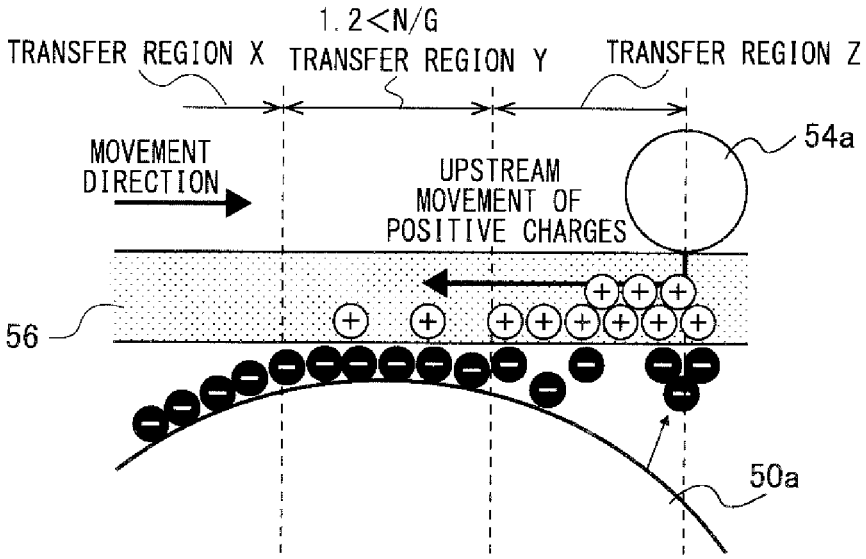
FIG. 9C is a schematic diagram for describing electrical charge transfer in the primary transfer portion in the case where $1.2 \leq N/G$ holds.

FIGS. 9A to 9C schematically illustrate the charge density in the intermediate transfer belt 56 in the case where N/G is smaller than that of the present exemplary embodiment, in the case of the present exemplary embodiment where N/G is in the range of 0.75 to 1.2, and in the case where N/G is larger than that of the present exemplary embodiment. To be noted, it is assumed that the current that flows in the intermediate transfer belt 56 is constant in all the cases. The charge densities in the transfer regions X to Z in the case where N/G is smaller than 0.75 are respectively referred to as ρX1, ρY1, and ρZ1. The charge densities in the transfer regions X to Z in the case where N/G is in the range of the present exemplary embodiment are respectively referred to as ρX2, ρY2, and ρZ2. Further, the charge densities in the transfer regions X to Z in the case where N/G is larger than 1.2 are respectively referred to as ρX3, ρY3, and ρZ3.

As illustrated in FIGS. 9A to 9C, charges injected from the primary transfer roller 54*a* flows upstream in the intermediate transfer belt 56 because the primary transfer roller 54*a* is offset downstream in the movement direction of the intermediate transfer belt 56 with respect to the photosensitive drum 50*a*. As illustrated in FIG. 9A, in the case where N/G is smaller than that of the present exemplary embodiment, the amount of charges that flow to the transfer region X is large, and thus the charge density ρX1 in the transfer region X tends to be large. Therefore, in the case where N/G is too small, the electric field intensity in the transfer region X is high, and upstream scattering becomes likely to occur.

In contrast, in the case where N/G is larger than that of the present exemplary embodiment, as illustrated in FIG. 9C, the charge density ρZ3 in the transfer region Z is large, and the amount of charges that move by electrical discharge is large. Therefore, in the case where N/G is larger than that of the present exemplary embodiment, the charge density ρY3 in the transfer region Y is small, the electric field intensity in the transfer region Y is low, and therefore there is a tendency that toner is not sufficiently transferred from the photosensitive drum 50*a* onto the intermediate transfer belt 56. Further, the toner remaining on the photosensitive drum 50*a* without being transferred in the transfer region Y becomes likely to scatter on the intermediate transfer belt 56 in the transfer region Z.

In contrast, in the case where N/G is in the range of 0.75 to 1.2 as in the present exemplary embodiment, as illustrated in FIG. 9B, the charge density ρX2 in the transfer region X is smaller than the charge density ρX1 of the case where N/G is smaller than that of the present exemplary embodiment, and thus the electric field intensity in the transfer region X is also lower. Therefore, upstream scattering becomes less likely to occur. Further, in the case where N/G is in the range of the present exemplary embodiment, the charge density ρY2 in the transfer region Y is larger than the charge density ρY3 of the case where N/G is larger than that of the present exemplary embodiment, and thus the electric field intensity in the transfer region Y is also higher. Therefore, toner is sufficiently transferred from the photosensitive drum 50*a* onto the intermediate transfer belt 56 in the transfer region Y, and therefore scattering in the transfer region Z becomes less likely to occur.

That is, as a result of ρY1>ρY2 being satisfied, the electric field intensity in the transfer region Y is higher in the case of the present exemplary embodiment than in the case where N/G is smaller than that of the present exemplary embodiment. In contrast, in the case where N/G is larger than that of the present exemplary embodiment, the amount of charges that move from the intermediate transfer belt 56 to the photosensitive drum 50*a* by electrical discharge in the transfer region Z is larger than in the case where N/G is in the range of the present exemplary embodiment, and thus ρZ2≈ρZ3 is satisfied. As a result of the intermediate transfer belt 56 losing charges by electrical discharge, ρY2>ρY3 is satisfied in the transfer region Y, and thus the electric field intensity in the transfer region Y is higher in the case where N/G is in the range of the present exemplary embodiment than in the case where N/G is larger than that of the present exemplary embodiment. Therefore, by setting N/G in the range of 0.75 to 1.2 as in the present exemplary embodiment, upstream scattering and downstream scattering can be reduced.

In addition, in the case where N/G is larger than 1.2, in the transfer region Z, the amount of charges that move from the intermediate transfer belt 56 to the photosensitive drum 50*a* by electrical discharge is large and therefore an electrical discharge trace is generated. Therefore, by setting N/G to 1.2 or less, generation of an electrical discharge trace can be also reduced. Further, in consideration of variations of N/G, N/G is preferably set to be smaller than 1.0 to more reliably reduce an electrical discharge trace.

Measurement Results of Blur

Next, measurement results of Blur, which is a characteristic value of toner scattering will be described. The measurement was performed on a 4-dot line image of a single color of black toner in the sub-scanning direction formed on a paper sheet CS-068 manufactured by Canon Inc. by using PIAS-II manufactured by QEA as described with reference to FIG. 4. The line measurement conditions are also the same as in the case described with reference to FIG. 4. To be noted, Blur indicates blurring of lines, and a smaller Blur indicates that blurring of fine lines caused by toner scattering is smaller, that is, toner scattering is reduced.

Figure 10:
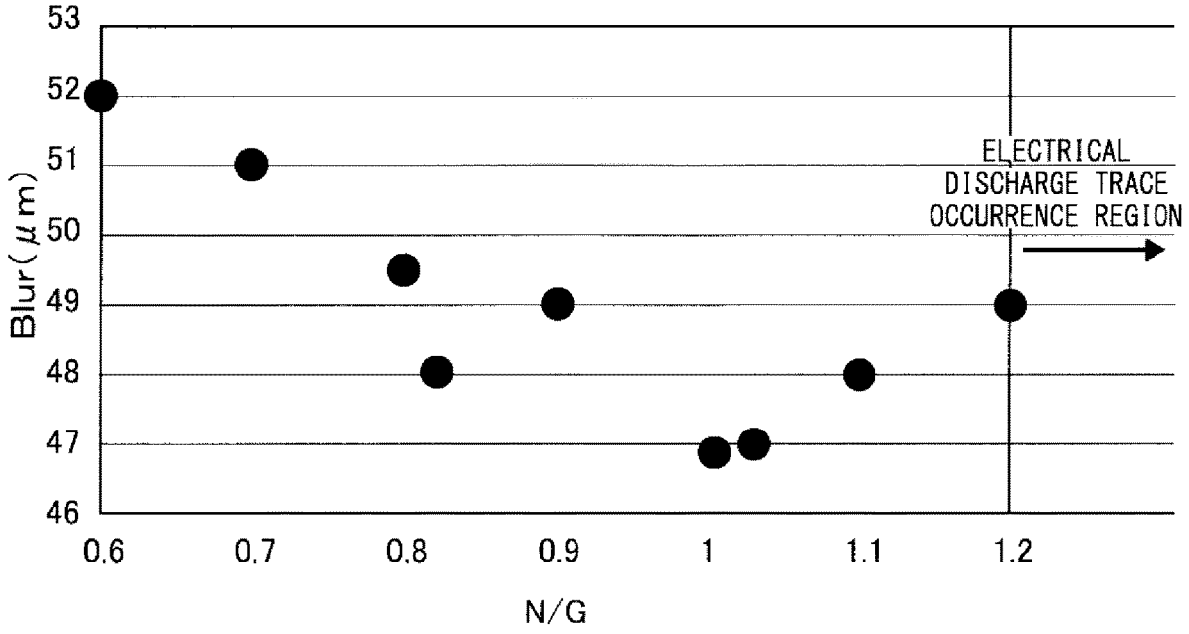
FIG. 10 is a graph showing a relationship between N/G and Blur.

Change in the value of Blur derived from toner scattering was checked by using the image forming apparatus illustrated in FIG. 1. The measurement was performed by setting the surface resistivity α of the base layer 56*a* of the intermediate transfer belt 56 in the range of $1.0\times10^{9}$ Ω/□≤α≤$1.0\times10^{13}$Ω/□ and changing N/G. As a result, it was found that Blur, which is a characteristic value of toner scattering, becomes small when N/G is set in the range of 0.75≤N/G≤1.2 as illustrated in FIG. 10. In addition, as illustrated in FIG. 10, it was found that, by setting N/G in the range of 0.75 to 1.2, generation of electrical discharge trace was reduced, and toner scattering was reduced as compared to the case where N/G was smaller than 0.75. To be noted, from the viewpoint of scattering, N/G being closer to 1 is more advantageous. Therefore, N/G is preferably 0.8 or more. In addition, N/G is more preferably larger than 0.9. Further, N/G is preferably smaller than 1.1 and more preferably smaller than 1.0. Therefore, for example, it is preferable that 0.9<N/G<1.0 is satisfied.

Experiment

Further, an experiment conducted to check the effect of the present exemplary embodiment will be described. In the experiment, image formation was performed while changing the surface resistivities α, β, N, and G of the base layer 56*a* and the surface layer 56*b* of the intermediate transfer belt 56, and scattering and electrical discharge traces were visually observed. The results of the experiment are shown in Table 1.

TABLE 1

| Base layer surface resistivity α (Ω/□) | Surface layer surface resistivity β (Ω/□) | N (Ω/□) | G (Ω/□) | N/G | Scattering | Electrical discharge trace |
|---|---|---|---|---|---|---|
| 2.0E+10 | 5.2E+10 | 1.9E+10 | 1.6E+10 | 1.2 | good | fair |
| 2.0E+10 | 4.0E+10 | 1.5E+10 | 1.4E+10 | 1.1 | good | fair |
| 2.0E+10 | 3.2E+10 | 1.3E+10 | 1.3E+10 | 1.0 | good | good |
| 2.0E+10 | 1.4E+10 | 4.3E+09 | 4.8E+09 | 0.9 | good | good |
| 2.0E+10 | 6.6E+09 | 3.5E+09 | 4.4E+09 | 0.8 | good | good |
| 2.0E+10 | 5.1E+09 | 2.5E+09 | 3.3E+09 | 0.8 | good | good |
| 2.0E+10 | 3.6E+09 | 1.9E+09 | 2.6E+09 | 0.7 | poor | good |
| 7.9E+09 | 1.4E+11 | 1.3E+10 | 1.1E+10 | 1.2 | good | fair |
| 7.9E+09 | 6.5E+10 | 8.3E+09 | 7.4E+09 | 1.1 | good | fair |
| 7.9E+09 | 3.0E+10 | 5.0E+09 | 5.0E+09 | 1.0 | good | good |
| 7.9E+09 | 1.8E+10 | 4.0E+09 | 4.3E+09 | 0.9 | good | good |
| 7.9E+09 | 6.5E+09 | 2.0E+09 | 2.5E+09 | 0.8 | good | good |
| 7.9E+09 | 4.5E+09 | 1.6E+09 | 2.1E+09 | 0.8 | good | good |
| 7.9E+09 | 3.1E+09 | 1.3E+09 | 1.8E+09 | 0.7 | poor | good |

As can be seen from Table 1, it was found that occurrence of scattering and electrical discharge traces can be reduced in the case where N/G satisfies 0.75≤N/G≤1.2. In addition, although not shown in Table 1, the experiment was also performed for a case where N/G was 0.75, and it was confirmed that there was no problem of scattering and electrical discharge traces in this case. In addition, in the case where N/G was larger than 1.2, the results of electrical discharge trace was poor. To be noted, as can be seen from Table 1, the magnitude relationship between the surface resistivities α and β of the base layer 56*a* and the surface layer 56*b* is not directly reflected on the magnitude relationship between N and G. Therefore, a desired N/G cannot be obtained by simply defining the magnitude relationship between α and β. However, as described above, in the case where the surface resistivity β of the surface layer 56*b* is set to a constant value, N/G becomes larger as the surface resistivity α of the base layer 56*a* becomes larger. Therefore, in the present exemplary embodiment, in consideration of these points, the surface resistivities and thicknesses of the base layer 56*a* and the surface layer 56*b* are adjusted such that a desired N/G can be obtained.

Other Embodiments

Although a configuration of at least two layers including a base layer and a surface layer has been described for the intermediate transfer belt in the exemplary embodiment described above, a single layer structure may be employed. In this case, it is preferable that 0.75≤N/G≤1.2 is satisfied by causing the resistivity of the intermediate transfer belt to have a gradient in the thickness direction such that the outer peripheral surface and inner peripheral surface thereof have different surface resistivities. In addition, also in the case of the single layer structure, it is more preferable that 0.8≤N/G<1.0 is satisfied, and it is further preferable that 0.9<N/G<1.0 is satisfied.

In addition, in the case where the intermediate transfer belt has a bilayer structure including the base layer and the surface layer as in the exemplary embodiment described above, N/G is likely to be deviated from 1.0. However, in this case, it is preferable that N/G satisfies 0.8≤N/G<1.0.

In addition, the photosensitive member may be, for example, a photosensitive belt which is a belt-like photosensitive member instead of the photosensitive drum. In addition, the transfer member may be, for example, a primary transfer blade having a blade-like shape instead of the primary transfer roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-234943, filed Dec. 14, 2018, which is hereby incorporated by reference herein in its entirety.

What is claimed is:

1. An image forming apparatus comprising:

a photosensitive drum configured to bear a toner image;

a rotatable intermediate transfer belt configured to come into contact with the photosensitive drum at a first contact area on an outer peripheral surface thereof, bear the toner image transferred thereto from the photosensitive drum, and transfer the toner image onto a recording material at a secondary transfer area; and a transfer roller configured to come into contact with an inner peripheral surface of the intermediate transfer belt at a second contact area, and transfer the toner image on the photosensitive drum onto the intermediate transfer belt by being applied a transfer bias, wherein the transfer roller is disposed such that an upstream end of the second contact area is positioned downstream of a downstream end of the first contact portion in the area and upstream of the secondary transfer area with respect to a rotation direction of the intermediate transfer belt, wherein the intermediate transfer belt comprises a base layer and a surface layer provided on an outer peripheral surface of the base layer, wherein, in a case where a surface resistivity measured on the outer peripheral surface of the intermediate transfer belt is G and a surface resistivity measured on the inner peripheral surface of the intermediate transfer belt is N, 0.75≤N/G≤1.2 is satisfied, and wherein $1.0\times10^{9}\Omega/\square\leq N\leq1.0\times10^{13}\Omega/\square$ is satisfied.

2. The image forming apparatus according to claim 1, wherein the intermediate transfer belt satisfies $0.8\leq N/G<1.0$.

3. The image forming apparatus according to claim 1, wherein the intermediate transfer belt satisfies $0.9<N/G<1.0$.

4. The image forming apparatus according to claim 1, wherein a thickness D of the base layer satisfies 30 $\mu m\leq D\leq100$ μm.

5. The image forming apparatus according to claim 1, wherein a surface resistivity β of the surface layer itself satisfies $4.0\times10^{9}\ \Omega/\square\leq\beta\leq5.0\times10^{10}\Omega/\square$.

6. The image forming apparatus according to claim 1, wherein a thickness E of the surface layer satisfies 1 $nm\leq E\leq20.0$ μm, wherein a thickness D of the base layer satisfies 30 $\mu m\leq D\leq100$ μm, wherein $1.9\times10^{9}\Omega/\square\leq G\leq1.5\times10^{10}\Omega/\square$ is satisfied, and wherein $1.4\times10^{9}\Omega/\square\leq N\leq1.8\times10^{10}\Omega/\square$ is satisfied.

7. The image forming apparatus according to claim 1, wherein a transfer current Itg that flows between the transfer roller and the photosensitive drum when the transfer bias is applied to the transfer roller satisfies 5.0 $\mu A\leq Itg\leq40$ μA.

8. The image forming apparatus according to claim 1, wherein an offset amount F of a rotation center of the transfer roller with respect to a rotation center of the photosensitive drum in a rotation direction of the intermediate transfer belt satisfies 4.0 $mm\leq F\leq7.0$ mm.

9. The image forming apparatus according to claim 1, wherein a contact angle θ of n-hexadecane on the surface layer satisfies $10°\leq\theta\leq90°$.

10. The image forming apparatus according to claim 1, wherein $1.4\times10^{9}\ \Omega/\square\leq N\leq1.8\times10^{10}\Omega/\square$ is satisfied.

11. The image forming apparatus according to claim 1, wherein $1.9\times10^{9}\ \Omega/\square\leq G\leq1.5\times10^{10}\Omega/\square$ is satisfied.

12. The image forming apparatus according to claim 1, wherein the base layer contains at least one of polyimide, polyamide, polyphenylene sulfide, polyetherimide, and polyether ether ketone.

13. The image forming apparatus according to claim 1, wherein the surface layer contains at least a binder resin and perfluoropolyether.

14. The image forming apparatus according to claim 1, wherein the transfer roller is a metal roller.

15. An image forming apparatus comprising:

a photosensitive drum configured to bear a toner image;

a rotatable intermediate transfer belt configured to come into contact with the photosensitive drum at a first contact area on an outer peripheral surface thereof, bear the toner image transferred thereto from the photosensitive drum, and transfer the toner image onto a recording material at a secondary transfer area; and a transfer roller configured to come into contact with an inner peripheral surface of the intermediate transfer belt at a second contact area, and transfer the toner image on the photosensitive drum onto the intermediate transfer belt by being applied a transfer bias, wherein the transfer roller is disposed such that an upstream end of the second contact area is positioned downstream of a downstream end of the first contact area and upstream of the secondary transfer area with respect to a rotation direction of the intermediate transfer belt, wherein the intermediate transfer belt is formed to have different resistivities on the outer peripheral surface side and the inner peripheral surface side thereof, and in a case where a surface resistivity measured on the outer peripheral surface of the intermediate transfer belt is G and a surface resistivity measured on the inner peripheral surface of the intermediate transfer belt is N, $0.75\leq N/G\leq1.2$ is satisfied, and wherein $1.0\times10^{9}\Omega/\square\leq N\leq1.0\times10^{13}\Omega/\square$ is satisfied.

16. The image forming apparatus according to claim 15, wherein the transfer roller is a metal roller.

17. The image forming apparatus according to claim 15, wherein $1.4\times10^{9}\ \Omega/\square\leq N\leq1.8\times10^{10}\Omega/\square$ is satisfied.

18. The image forming apparatus according to claim 15, wherein $1.9\times10^{9}\ \Omega/\square\leq G\leq1.5\times10^{10}\Omega/\square$ is satisfied.

* * * * *